United States Patent [19]

Barakitis et al.

[11] Patent Number: 5,057,741

[45] Date of Patent: Oct. 15, 1991

[54] GLOW DISCHARGE STARTER HAVING DUAL GAPS

[75] Inventors: Nikolaos Barakitis, Salem, Mass.; Marvin S. Corrales, Gravilias San Jose; Jorge C. Rodrigues, San Jose, both of Costa Rica

[73] Assignee: GTE Products Corporation, Danvers, Mass.

[21] Appl. No.: 620,165

[22] Filed: Nov. 30, 1990

[51] Int. Cl.[5] ..... H01J 7/44

[52] U.S. Cl. ..... 313/619; 313/620; 313/621

[58] Field of Search ..... 313/619, 620, 621; 337/22, 26, 27; 315/73

[56] References Cited

U.S. PATENT DOCUMENTS

| | | | |
|---|---|---|---|
| 4,845,406 | 7/1989 | Barakitis et al. | 313/558 |
| 4,938,727 | 7/1989 | Barakitis et al. | 445/40 |
| 4,970,425 | 11/1990 | Barakitis | 313/619 |
| 5,001,391 | 3/1991 | Kling et al. | 313/619 |

*Primary Examiner*—Donald J. Yusko
*Assistant Examiner*—Nimeshkumar D. Patel
*Attorney, Agent, or Firm*—Carlo S. Bessone

[57] ABSTRACT

A glow discharge starter having an hermetically sealed envelope containing an ionizable medium, a bimetallic electrode including a bimetallic element, and a counter electrode. The bimetallic element has a free end adapted to form first and second discharge gaps with the counter electrode. The first discharge gap has a spacing which varies during operation of the glow discharge starter. The spacing of the second discharge gap remains relatively constant. Problems associated with high ambient temperatures can be overcome by increasing the initial spacing of the first discharge gap without affecting the electrical breakdown voltage of the glow discharge starter. In accordance with a preferred embodiment, the free end of the bimetallic element has a first portion substantially parallel to the counter electrode and a second portion substantially perpendicular to the counter electrode. Preferably, the initial spacing of the first discharge gap measured at 25 degrees Celsius is within the range of from about 0.020 inch to about 0.030 inch. The spacing of the second discharge gap is within the range of from about 0.006 inch to about 0.010 inch.

7 Claims, 2 Drawing Sheets

GLOW DISCHARGE STARTER HAVING DUAL GAPS

TECHNICAL FIELD

This invention relates in general to glow discharge starters for arc discharge lamps and more particularly to glow discharge starters intended for higher lamp voltages and higher ambient temperatures.

BACKGROUND OF THE INVENTION

A glow discharge starter is usually connected across or in parallel with an arc discharge lamp and contains a pair of electrodes. At least one of the electrodes comprises a bimetallic element which, when heated as a result of the glow discharge, bends towards the other electrode When contact is made, the glow discharge ceases causing the bimetallic element to cool and withdraw from the contacted electrode. When contact is broken, a voltage pulse induced by the induction of the ballast, appears across the opposed electrodes of the lamp thereby initiating an arc discharge within the lamp. If the lamp ignition does not occur after the first voltage pulse, the glow discharge sequence is repeated until lamp ignition occurs.

It is known to include a mixture of materials, which may comprise barium, magnesium and thorium, within the glow discharge starter. This mixture, although referred to a getter material or getter mixture, not only removes deleterious gases that may form during processing or during operation of the glow discharge starter, but also lowers the breakdown voltage of the starter. The getter material may be supported by a getter holder which consists of a small piece of metal in which a cup is generally formed. The getter mixture is contained within the cup. During fabrication and processing of the glow discharge starter, the getter mixture contained within the cup of the getter holder is "flashed" onto the internal surface of the envelope and internal parts of the glow discharge starter. Flashing is a well known process accomplished by means of a radio frequency generator commonly referred to as a bomber. The above mentioned process creates a more effective surface for improved gettering of deleterious gases within the glow discharge starter. However, to be effective at lowering the breakdown voltage, the material must be disposed on the electrically connected active parts of the starter.

The glow discharge starter is designed such that the contacts close at a voltage chosen between the maximum lamp voltage and the minimum supply voltage (i.e., closure voltage). The contacts of the starter must also remain open at voltages less than the maximum lamp voltage (i.e., non-reclosure voltage). The development of compact fluorescent lamps, wherein the glow discharge starter is contained within the lamp base, has placed more stringent requirements on the glow starters. One of these is the requirement for reliability in a high temperature environment up to about 200 degrees Celsius. Since a glow discharge starter is a temperature-sensitive device, the increased temperature tends to change the operating characteristics of the starter by decreasing the discharge gap between the free end of the bimetallic element and the counter electrode. Some of these high temperature glow discharge starters are also required to operate with higher wattage lamps (e.g., up to 50 watts). Among newly developed are 18, 22 and 28 watt compact fluorescent lamps. To be suitable to operate these three lamps, a starter should have a minimum closure voltage of 105 volts and a maximum non-reclosure voltage of at least 85 volts. It is important that the electrical parameters of the glow discharge starter remain within this range throughout the life of the starter. A conventional glow discharge starter intended for low lamp voltage applications does not meet the temperature requirement. Temperatures above 100–120 degrees Celsius generally disable these starters. Maintaining electrical parameters within the 105/85 volt range is difficult to control.

The switching transient voltage output of the device depends upon the flexure and shape of the bimetallic element. Greater flexure distortion normally causes higher pulse voltages. During this thermal distortion, the spacing between the bimetallic element and counter electrode is decreased and adversely affects the breakdown voltage. Keeping the breakdown voltage in the desired range, requires a larger gap. This inconsistency demands compromise and often means difficulties in production and increases in cost.

A solution to improve high temperature operation is to increase the spacing between the free end of the bimetallic element and the counter electrode. However, this solution often results in the loss of operating voltage control. For example, in a single discharge gap starter, increasing this spacing to compensate for the increase in ambient temperature, also increases the closure voltage of the starter. For high line voltage applications (i.e., 220–240 volts AC), the problem can be overcome with tight control of this spacing. However this can result in a smaller yield in production or higher cost.

Attempts have been made to avoid the above-mentioned problems by utilizing complex gases to stabilize the characteristics of the glow discharge starter during its life. These gas compositions have included light gases (e.g., helium and hydrogen) which can be absorbed by the starter envelope, getter or internal metal parts.

U.S. Pat. Nos. 4,845,406 and 4,938,727, which are assigned to the Assignee of the present Application, teach a glow discharge starter having a pair of discharge gaps. One discharge gap is formed between the curved portion of a bimetallic element and and a getter holder which is secured to a counter electrode. Another discharge gap is formed between the free end of the bimetallic element and the counter electrode. While the above glow discharge starter performs satisfactorily, this starter requires the use of a separate getter holder in order to form one of the discharge gaps.

SUMMARY OF THE INVENTION

It is therefore, an object of the invention to obviate the disadvantages of the prior art.

It is another object of the invention to provide an improved glow discharge starter suitable for higher lamp voltages and higher ambient temperatures.

It is still another object of the invention to provide an improved glow discharge starter which employs dual discharge gaps without requiring a separate getter holder secured to the counter electrode.

It is still another object of the invention to provide an improved method of manufacturing a glow discharge starter.

These objects are accomplished, in one aspect of the invention, by the provision of a glow discharge starter comprising an hermetically sealed envelope containing an ionizable medium, a bimetallic electrode and a counter electrode. The bimetallic electrode includes a bimetallic element having a free end adapted to form with the counter electrode a first discharge gap which has a variable spacing during operation of the glow discharge starter and a second discharge gap which has a substantially constant spacing during operation of the glow discharge starter.

In accordance with further aspects of the invention, the free end of the bimetallic element has a first portion substantially parallel to the counter electrode. The first portion of the free end of the bimetallic element has a surface adjacent the counter electrode. The first discharge gap is formed between this surface and the counter electrode. Preferably, the spacing of the first discharge gap at 25 degrees Celsius is within the range of from about 0.020 inch to about 0.030 inch.

In accordance with still further aspects of the invention, the free end further includes a second portion substantially perpendicular to the counter electrode. The second portion of the free end of the bimetallic element has a side surface adjacent the counter electrode. The second discharge gap is formed between this side surface and the counter electrode. Preferably, the spacing of the second discharge gap at 25 degrees Celsius is within the range of from about 0.006 inch to about 0.010 inch.

BRIEF DESCRIPTION OF THE DRAWINGS

The invention will become more readily apparent from the following exemplary description in connection with the accompanying drawings, wherein.

BEST MODE FOR CARRYING OUR THE INVENTION

For a better understanding of the present invention, together with other and further objects, advantages and capabilities thereof, reference is made to the following disclosure and appended claims taken in conjunction with the above-described drawings.

Figure 1:
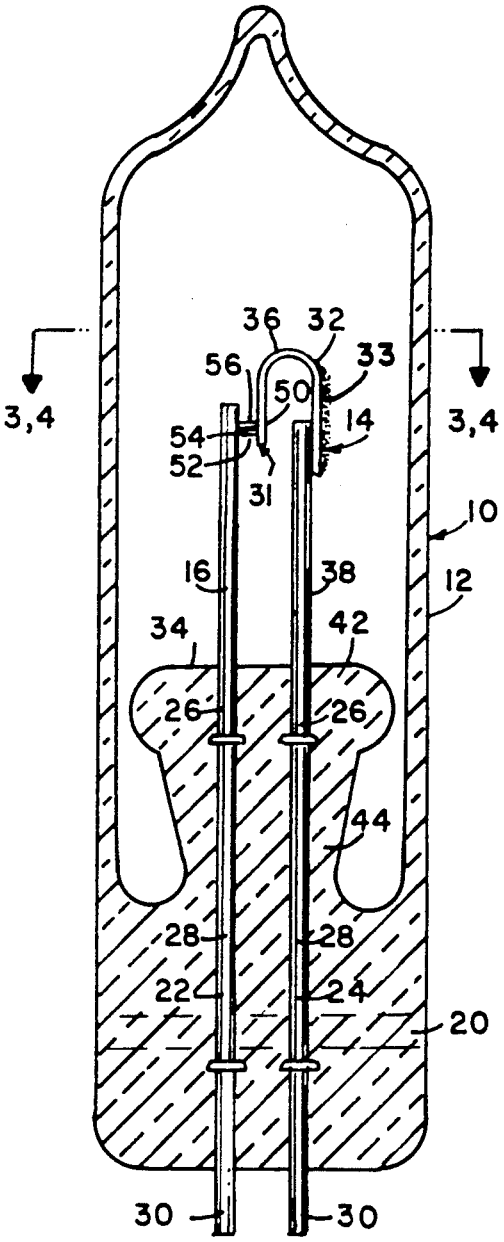
FIG. 1 represents a sectional, front elevational view of an embodiment of a glow discharge starter according to the invention.
Figure 2:
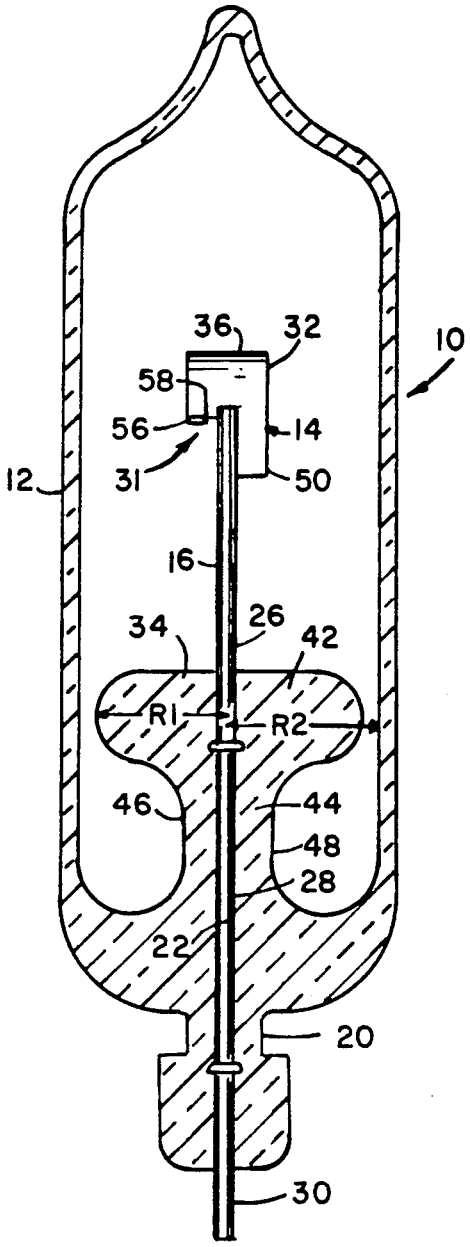
FIG. 2 is a sectional, side elevational view of the glow discharge starter of FIG. 1 showing the position of the bimetallic element at room temperature.

Referring now to the drawings with greater particularity, there is shown in FIGS. 1 and 2 a glow discharge starter 10 comprising an hermetically sealed tubular-shaped envelope 12. An ionizable medium, comprising an inert gas or combinations thereof at a low pressure typically within the range of from about 12.0 torr to about 18.0 torr, is contained within envelope 12. A bimetallic electrode 14 (which includes a bimetallic element 32) and a counter electrode 16 are sealed to a glass mount or stem 34 which is sealed to envelope 12 by means of a press seal 20 located at one end of envelope 12. One end of bimetallic element 32 is secured to a post 38 by welding.

During formation of press seal 20, the axis of a conventional mount often becomes angled with respect to the axis of the envelope causing either the bimetallic electrode or the counter electrode to touch the internal surface of the glass tubing. As a result, the electrical characteristics of the glow discharge starter are altered. Also, the heat and gases from the press sealing fires flow upwards through the glass tubing in the region between glass stem 18 and the internal surface glass tubing 12 in a so-called "chimney effect". As a result, the surface of the bimetallic element is oxidized.

In accordance with the teachings of U.S. Pat. No. 4,970,425, which is assigned to the same Assignee as the present application, glass stem 34 is preferably T-shaped and includes a transverse portion such as disk-shaped portion 42 extending substantially across envelope 12. Disk-shaped member 42 lies in a plane substantially perpendicular to lead-in conductors 22, 24 and has a radius R1 (FIG. 1). Radius R1 of disk-shaped portion 42 is preferably within the range of from about 89 to 93 percent of the internal radius R2 of envelope 12 so as to reduce the "chimney effect" enough to eliminate the formation of oxidation on the bimetallic element.

In addition to eliminating oxidation of the bimetallic element, the transverse portion improves alignment of the electrode by centering the glass mount and preventing the electrodes from touching the internal surface of the envelope.

A longitudinally-extending planar portion 44 projects from a lower surface of disk-shaped portion 42 and is provided with a pair of substantially parallel surfaces 46, 48 (FIG. 2) spaced a predetermined distance thereapart. Parallel surfaces 46, 48 lie in respective planes parallel to a plane passing through the two lead-in conductors 22, 24. Preferably, the distance between the pair of substantially parallel surfaces 46, 48 is not greater than about four times the diameter of portion 28 of the lead-in conductors associated with the planar portion of the glass stem.

The relatively thin planar portion reduces the occurrence of seal cracks since during sealing the planar portion can more quickly reach the proper temperature for sealing. Moreover, the planar portion is substantially thinner than the transverse portion so that the heat from the sealing fires is not transferred upwards through the stem enough to cause softening of the entire stem and permanent distortion in the parallel relationship of the electrodes.

As illustrated in FIGS. 1 and 2, electrodes 14 and 16 are electrically connected to or formed from lead-in conductors 24 and 22, respectively. Lead-in conductors 22 and 24 consist of an upper nickel/iron segment 26, an intermediate "Dumet" segment 28 and a lower copper segment 30. Bimetallic electrode 14 includes a post 38 (FIGS. 1 and 3) and a bimetallic element 32. Bimetallic element 32, which includes a curved portion 36 and a free end 31, consists of two strips of metal having different linear coefficients of expansion welded together. The side of lower coefficient of expansion is formed of a nickel-steel alloy while the side of higher expansion is formed of chrome iron. The side of higher coefficient of expansion is on the outside (i.e., the side away from counter electrode 16) such that a portion of free end 31 engages counter electrode 16 upon flexure of bimetallic element 32.

A coating 33 of zirconium may be disposed on a portion of bimetallic element 32.

In accordance with the teachings of the present invention, free end 31 of bimetallic element 32 is adapted to form a pair of discharge gaps with counter electrode 16. In the embodiment shown in FIG. 1, free end 31 has a first portion 50 substantially parallel to and adjacent counter electrode 16. A first discharge gap 52 is formed between a surface 54 on first portion 50 and counter electrode 16.

Figure 3:
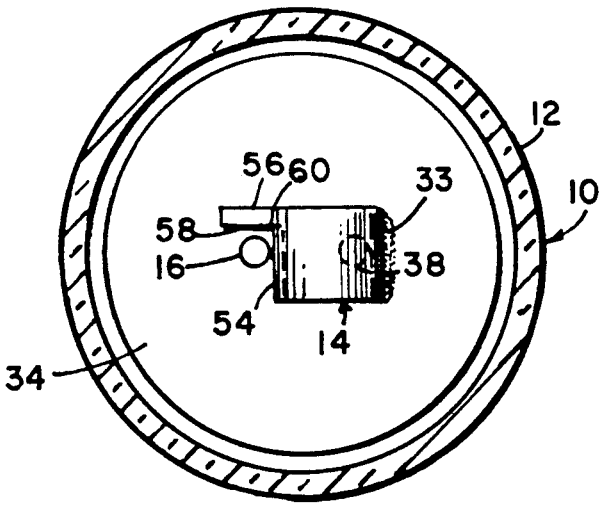
FIG. 3 is an enlarged, top elevational view of the glow discharge starter in FIG. 2 taken along the line 3—3 showing the position of the bimetallic element at an elevated temperature.

The spacing of first discharge gap 52 changes as the result of flexure of bimetallic element 32 caused by the heating action of the discharge or by changes in the ambient temperature. As best shown in FIG. 3, the heating action of the discharge between the electrodes causes discharge gap 52 to decrease until surface 54 on first portion 50 touches a portion of counter electrode 16 causing t he extinguishing of the discharge and cooling of the bimetallic element.

Typically, the spacing of first discharge gap 52 is within the range of from about 0.020 inch to about 0.030 inch at 25 degrees Celsius. Discharge gap 52 can be adjusted during manufacturing by bending bimetallic element 32 at the curved portion 36 or by adjusting the electrode spacing distance prior to sealing the lead-in conductors in glass mount 34.

As shown in FIGS. 1—4, free end 31 of bimetallic element 32 further includes a second portion 56 substantially perpendicular to counter electrode 16. A second discharge gap 58, which has a relatively constant spacing during operation, is formed between a side surface 60 on second portion 56 and counter electrode 16. Second discharge gap 58 is responsible for the electrical breakdown and heating of the bimetallic element 32 when a voltage potential is applied across lead-in conductors 22, 24.

Typically, the spacing of discharge gap 58 is within the range of from about 0.006 inch to about 0.010 inch at 25 degrees Celsius. Second discharge gap 56 can be adjusted during manufacturing by proper positioning of the electrodes prior to sealing the lead-in conductors in glass mount 34.

Figure 4:
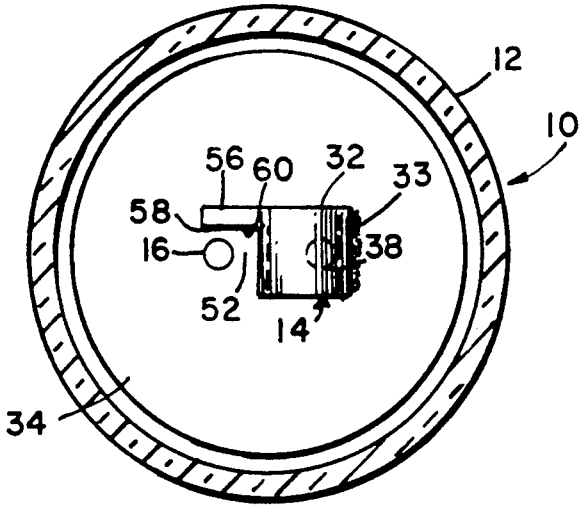
FIG. 4 is an enlarged, top elevational view of the glow discharge starter in FIG. 2 taken along the line 4—4 showing the position of the bimetallic element at room temperature.

As best illustrated in FIGS. 3 and 4, the spacing of second discharge gap 56 remains relatively constant during operation of the glow discharge starter. More specifically, the spacing of second discharge gap 58 is substantially the same both at room temperature (i.e., 25° Celsius) as illustrated in FIG. 4 and at an elevated temperature produced by the discharge as illustrated in FIG. 3. The above-mentioned problems associated with high ambient temperatures can be overcome by increasing the spacing of first discharge gap 52 without adjusting the second discharge gap 58, the latter of which affects the electrical breakdown voltage of the glow discharge starter.

As to the manufacture of the above-described glow discharge starters, a bimetallic element consisting of a strip of bimetal material is provided. A longitudinal cut of approximately 0.060 inch is made in one end of the bimetal strip in order to form two portions. One portion of the bimetallic element is bent approximately 90 degrees with respect to the axis of the bimetallic element. The opposite end of the bimetallic element is secured to a lead-in conductor so as to form a bimetallic electrode. The two portions of the free end of the bimetallic element are positioned with respect to a second lead-in conductor (i.e., the counter electrode) and adjusted to form the pair of discharge gaps. The bimetallic electrode and the counter electrode are held in place and sealed within a glass mount which is eventually sealed to a suitable envelope. The glow discharge starter is finished using convention manufacturing techniques.

In a typical but not limiting example of a glow discharge starter made in accordance with the teachings of the present invention, the envelope is formed from potash soda lead glass having an outside diameter of 0.285 inch (7.2 millimeters), a wall thickness of 0.027 inch (0.69 millimeters) and an overall length of 1.1 inch (28 millimeters). The spacing of the first discharge gap was approximately 0.025 inch (0.635 millimeter) and the spacing of the second discharge gap was approximately 0.008 inch (0.203 millimeter). The envelope was filled with argon gas at a pressure of approximately 15 torr.

While there have been shown and described what are at present considered to be the preferred embodiments of the invention, it will be apparent to those skilled in the art that various changes and modifications can be made herein without departing from the scope of the invention. The embodiments shown in the drawings and described in the specification are intended to best explain the principles of the invention and its practical application to hereby enable others in the art to best utilize the invention in various embodiments and with various modifications as are suited to the particular use contemplated.

What is claimed is:

1. A glow discharge starter comprising an hermetically sealed envelope containing an ionizable medium, a bimetallic electrode and a counter electrode, said bimetallic electrode including a bimettalic element having a free end adapted to form first and second discharge gaps with said counter electrode, said first discharge gap having a variable spacing during operation of said glow discharge starter, said second discharge gap having a substantially constant spacing during operation of said glow discharge starter.

2. The glow discharge starter of claim 1 wherein said free end of said bimetallic element has a first portion substantially parallel to said counter electrode.

3. The glow discharge starter of claim 2 wherein said first portion of said free end of said bimetallic element has a surface adjacent said counter electrode, said first discharge gap being formed between said surface of said first portion and said counter electrode.

4. The glow discharge starter of claim 2 wherein said spacing of said first discharge gap at 25 degrees Celsius is within the range of from about 0.020 inch to about 0.030 inch.

5. The glow discharge starter of claim 1 wherein said free end of said bimetallic element has a second portion substantially perpendicular to said counter electrode.

6. The glow discharge starter of claim 5 wherein said second portion of said free end of said bimetallic element has a side surface adjacent said counter electrode, said second discharge gap being formed between said side surface of said second portion and said counter electrode.

7. The glow discharge starter of claim 5 wherein said substantially constant spacing of said second discharge gap at 25 degrees Celsius is within the range of from about 0.006 inch to about 0.010 inch.

* * * * *